US005494007A

United States Patent [19]

Schroeder et al.

[11] Patent Number: 5,494,007

[45] Date of Patent: Feb. 27, 1996

[54] METHOD AND APPARATUS FOR ELECTRICALLY DRIVING ENGINE VALVES

[75] Inventors: Thaddeus Schroeder, Rochester Hills; Rassem R. Henry, Clinton Township; Bruno P. B. Lequesne, Troy, all of Mich.

[73] Assignee: General Motors Corporation, Detroit, Mich.

[21] Appl. No.: 358,212

[22] Filed: Dec. 15, 1994

Related U.S. Application Data

[63] Continuation of Ser. No. 217,779, Mar. 25, 1994, abandoned, which is a continuation of Ser. No. 994,829, Dec. 22, 1992, Pat. No. 5,327,856.

[51] Int. Cl.[6] ..... F01L 13/00; F01L 9/04

[52] U.S. Cl. ..... 123/90.11; 123/90.15

[58] Field of Search ..... 123/90.11, 90.15, 123/90.17, 403, 405; 251/129.01, 129.11

[56] References Cited

U.S. PATENT DOCUMENTS

| | | | |
|---|---|---|---|
| 4,061,115 | 12/1977 | Predhome, Jr. | 123/90.16 |
| 4,432,310 | 2/1984 | Waller | 123/58 AB |
| 4,723,514 | 2/1988 | Taniuchi | 123/65 V |
| 4,744,338 | 5/1988 | Sapienza, IV | 123/90.15 |
| 4,915,083 | 4/1990 | Hewette et al. | 251/129.11 |
| 4,926,122 | 5/1990 | Schroeder et al. | 324/207.13 |
| 4,955,334 | 9/1990 | Kawamura | 123/90.11 |
| 5,000,131 | 3/1991 | Masuda | 123/65 PE |
| 5,016,583 | 5/1991 | Blish | 123/90.11 |
| 5,018,487 | 5/1991 | Shinkai | 123/90.16 |
| 5,060,910 | 10/1991 | Iwata et al. | 251/129.11 |
| 5,065,061 | 11/1991 | Satoh et al. | 310/104 |
| 5,119,772 | 6/1992 | Kawamura | 123/90.11 |
| 5,184,593 | 2/1993 | Kobayashi | 251/129.11 |
| 5,327,856 | 7/1994 | Schroeder et al. | 123/90.11 |

FOREIGN PATENT DOCUMENTS

| | | | |
|---|---|---|---|
| 391739 | 10/1990 | European Pat. Off. . | |
| 390519 | 10/1990 | European Pat. Off. . | |
| 2608675 | 6/1988 | France . | |
| 2616481 | 12/1988 | France . | |
| 8701505 | 9/1987 | Germany . | |
| 4109538 | 1/1992 | Germany | 123/90.11 |
| 256470 | 8/1926 | United Kingdom . | |
| 1369597 | 10/1974 | United Kingdom . | |
| 87/00574 | 1/1987 | WIPO . | |

OTHER PUBLICATIONS

"Servomotor controllers replace cams", England, Machine Design—May 11, 1989.

"High Performance Motion Profiles", David T. Robinson, Creonics Inc, Motion, Mar./Apr. 1990.

*Primary Examiner*—Weilun Lo

*Attorney, Agent, or Firm*—Charles K. Veenstra

[57] ABSTRACT

A cam mechanism is employed to convert motor rotation to reciprocating valve motion. Motor speed is reduced at the valve opening and closing times to reduce stress on the cam mechanism.

1 Claim, 8 Drawing Sheets

10
12
28
32
24
16
30
38
36
20
38
34
32
2
2
44
36
44
40
42
58
56
3
21
18
12
14
22

FIG 2
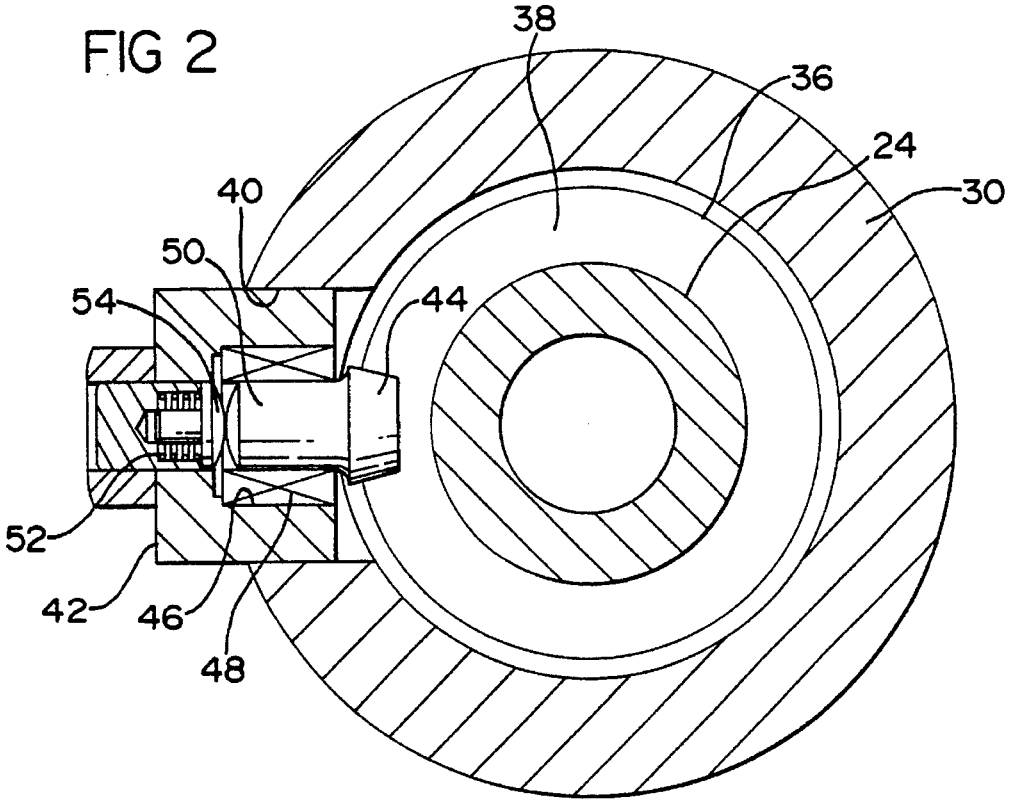
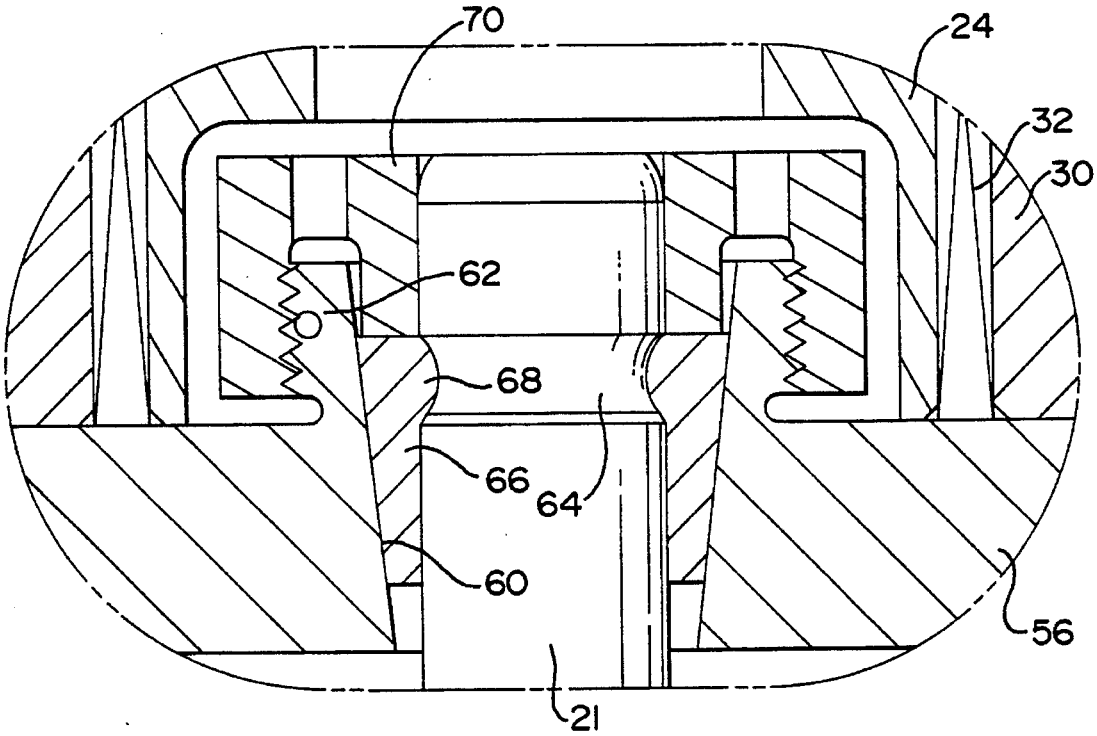
FIG 3

FIG 10
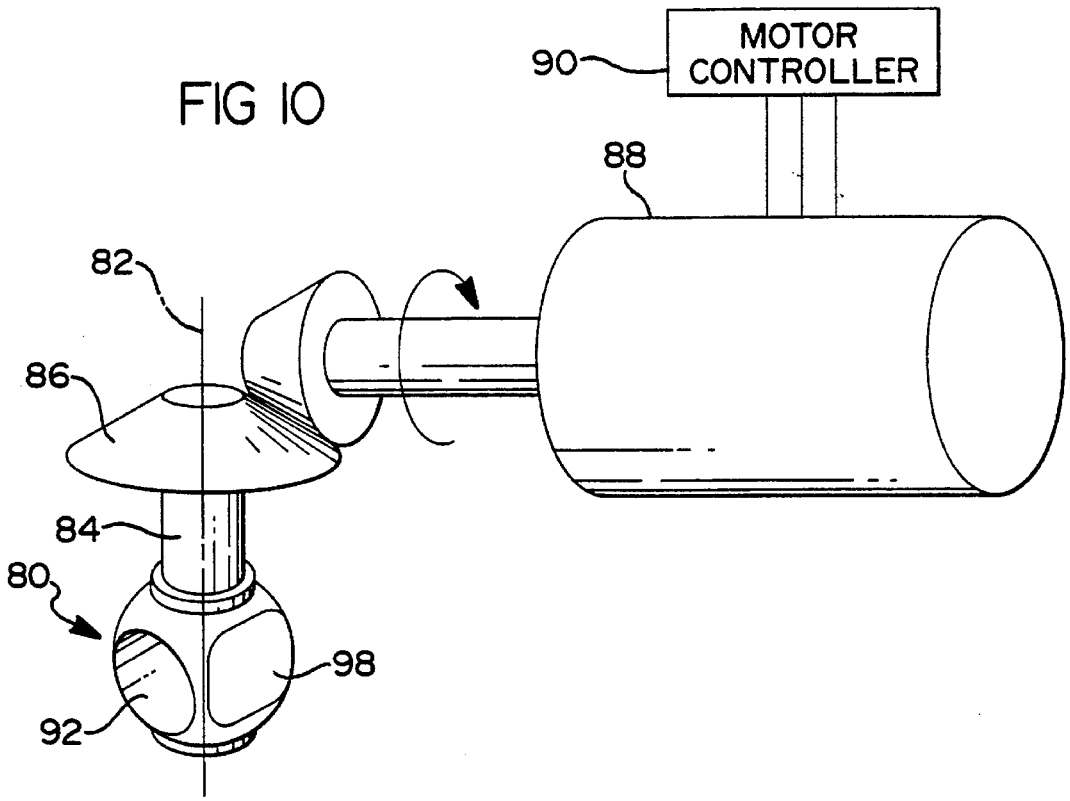
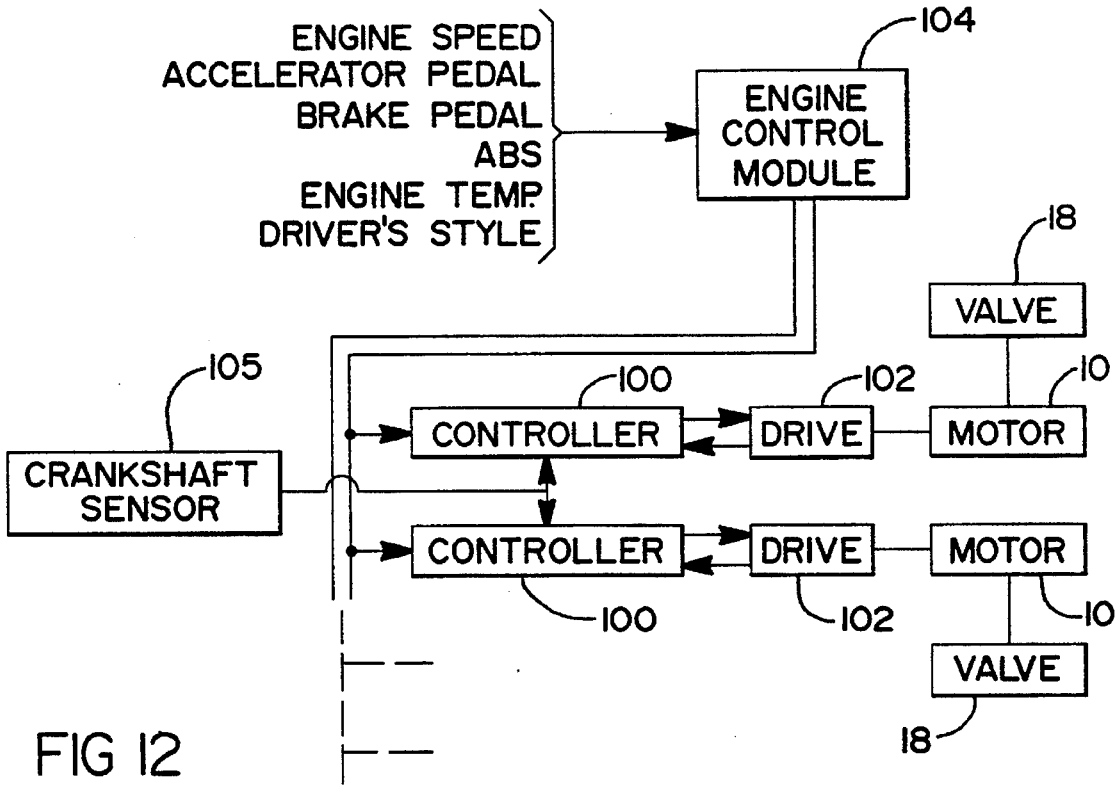
FIG 12

METHOD AND APPARATUS FOR ELECTRICALLY DRIVING ENGINE VALVES

This is a continuation of application Ser. No. 08/217,779 filed on Mar. 25, 1994, now abandoned, which was a continuation of application Ser. No. 07/994,829 filed on Dec. 22, 1992, now U.S. Pat. No. 5,327,856.

FIELD OF THE INVENTION

This invention relates to internal combustion engine valves and particularly to a method and apparatus for actuating such valves by electric motors.

BACKGROUND OF THE INVENTION

Traditionally the poppet valves of an engine have been actuated by one or more camshafts which are mechanically driven from the engine crankshaft at half the engine speed, thereby operating the valves in synchronism with engine rotation, and in a fixed phase with one another. It is also known to substitute rotary valves for poppet valves, again mechanically driving the valves from the crankshaft and rigidly slaving the valve operation to engine rotation.

It is known that the performance of engines can be improved by variable valve timing since the optimum timing is dependent on speed and load conditions. To change valve timing, it has been proposed to mechanically adjust the camshaft angle, in some cases using an electric motor to make the adjustment.

It is also known that engine performance can be further enhanced by controlling not only engine-valve timing, but also other aspects of valve operation such as the duration of open periods. To that effect, various mechanisms have been proposed such as direct, independent valve actuators moved by pneumatic, hydraulic or electromagnetic forces. While providing valve-profile flexibility, such mechanisms have often suffered various problems such as: inadequate control of the valve seating velocity, high energy consumption, and relatively long response time that precludes high engine speed operation. It is therefore advantageous to provide means of operating engine valves that give the desired high degree of valve-profile flexibility and at the same time feature the necessary low valve-seating velocity, allow the engine to operate over a standard speed range and have low energy requirements.

SUMMARY OF THE INVENTION

It is therefore an object of the invention to control valve operation independently of other valves. It is another object to flexibly actuate each valve in controlled synchronism with engine rotation without rigid coupling to the crankshaft. A further object is to electrically drive engine valves with a continuously rotating motor.

While it is generally required for synchronism of valve operation with engine (crankshaft) speed of a four-stroke cycle engine that for cam operated valves the cam speed must on average be ½ the engine speed, the cam speed can be varied within each engine cycle without losing synchronization, thus allowing variable valve timing. For instance, if the cam is run faster than average while the valve is open, then slowed down while it is closed, the valve event duration is shorter than when the cam speed is kept a constant ratio of the engine speed at all times. Conversely, if the cam runs slower while the valve is open, then is accelerated while the valve is closed, the appropriate average cam speed can be maintained for synchronization; yet, at the same time the valve event duration is lengthened compared to what it is with a constant ratio of cam speed to engine speed. In the same way, the rotation speed of rotary valves can be varied over each valve cycle while maintaining the average speed synchronized with engine speed.

To implement the variations of valve operation within a valve cycle, the poppet valve or the rotary valve is driven with a rotary electric motor. While more than one valve can be driven by one motor, for example the intake and exhaust valves on a given cylinder or two intake valves of a given cylinder, greater flexibility can be obtained by one motor for each valve. Thus, in the case of popper valves, each engine port is equipped with at least one popper valve, a cam mechanism for each popper valve for transforming rotary motor motion to reciprocating valve motion, and a motor driving each cam mechanism. A motor control determines the operation of each motor in accordance with the desired valve motion. The cam mechanism when operated by a constant speed motor establishes a basic valve lift profile which is wholly dependent on the cam shape and its coaction with a cam follower. Then by varying the motor speed within each valve cycle, the valve lift profile is modified to change properties such as timing, the duration of the open period, the rate of opening and closing, and even the amount of opening. The variation of motor speed can cause the motor to stop momentarily or to reverse direction, particularly where a partial opening of a valve is desired. There are circumstances, such as the reduction of engine power, where it is useful to stop one or more valve motors over several engine cycles.

An electric motor with continuous rotary motion is used to drive the valve since it is capable of high efficiency and is easily controlled by a microprocessor based controller. Also, continuous rotary motion is the easiest form of electrical-to-mechanical energy transformation. A motor optimized for speed-control characteristic, low inertia for fast response, and torque/volume characteristics for best packaging is preferred.

The motor controller algorithm was devised to bring about the largest possible valve-event flexibility while maintaining the required valve/engine synchronization. The degree of timing flexibility is very large at the lower and more commonly used engine speeds because then the engine cycle lasts a longer time. This flexibility diminishes at highest speeds because engine cycles are then shorter. The limit between "lower" and "higher" speed is determined by the system inertia and the motor torque-to-inertia characteristic. An important feature of this invention is that cam acceleration and deceleration take place primarily while the valve is closed. By contrast, previously known independent valve actuation systems accelerate and decelerate the valve during the valve open period. Our system is better because the valves are always closed for a longer period of time than they are open, and thus offers more time for motor acceleration and deceleration. The high speed flexibility limit is consequently higher than with other known independent valve actuation systems. Another significant advantage is that our system can be run at any speed, even beyond the reduced flexibility limit, because the valve motor can be run continuously at half the crankshaft speed. This allows the system to run at very high engine speeds, at and beyond 6000 rpm with fatigue stress being the only limiting factor. Furthermore, timing flexibility never disappears completely: at very high speeds, there is always the possibility of shifting the valve timing with respect to the engine top dead center to achieve "cam phasing" or to stop the valves to deactivate cylinders.

It will also be appreciated that the use of a cam mechanism allows tailoring the valve profile to achieve by design low valve seating velocity. Other known independent valve mechanisms do not have such an advantageous feature and means that have been proposed to correct this deficiency are all cumbersome and of limited efficacy. Further, with the proposed apparatus, valve profile changes are achieved by modulating the speed of the motor, and therefore low overall energy requirements can be expected. Many other independent valve actuation schemes, by contrast, must start and stop the actuator at each end of the valve travel, thereby requiring significantly more energy particularly at high speed when fast valve motion is required. The absence of a return spring as in conventional valve trains also contributes significantly to the low energy requirement. In the case of rotary valve actuation the cam mechanism does not apply but the timing flexibility by motor speed control does directly pertain.

BRIEF DESCRIPTION OF THE DRAWINGS

The above and other advantages of the invention will become more apparent from the following description taken in conjunction with the accompanying drawings wherein like references refer to like parts and wherein:

FIG. 2 is a cross section of the cam mechanism taken along line 2—2 of FIG. 1;

FIG. 3 is an enlarged view of the coupling of the valve stem to the cam mechanism shown as circle 3 of FIG. 1;

FIG. 10 is a schematic illustration of a rotary valve driven by an electric motor;

FIG. 12 is a schematic diagram of valve control system according to the invention.

DESCRIPTION OF THE INVENTION

Referring first to the invention as applied to popper valves of the kind conventionally employed in internal combustion engines, a conventional type of cam, driven by a rotary electric motor instead of a direct drive, may be adapted to actuate a single valve in the open direction with a spring to return the valve to its closed position. The advantage of using a cam mechanism is that the seating velocity of the valve can be set, by design, at a very low level. Typically, prior independent valve actuation designs lack that feature. However, a disadvantage of using a return spring is that it translates into a high instantaneous torque requirement for the electric motor. It is preferred then, that the cam mechanism drive the valve for both the opening and closing strokes, thereby spreading out the torque requirement over opening and closing motions of the valve open period. This reduces the peak torque and overall energy requirements.

Figure 1:
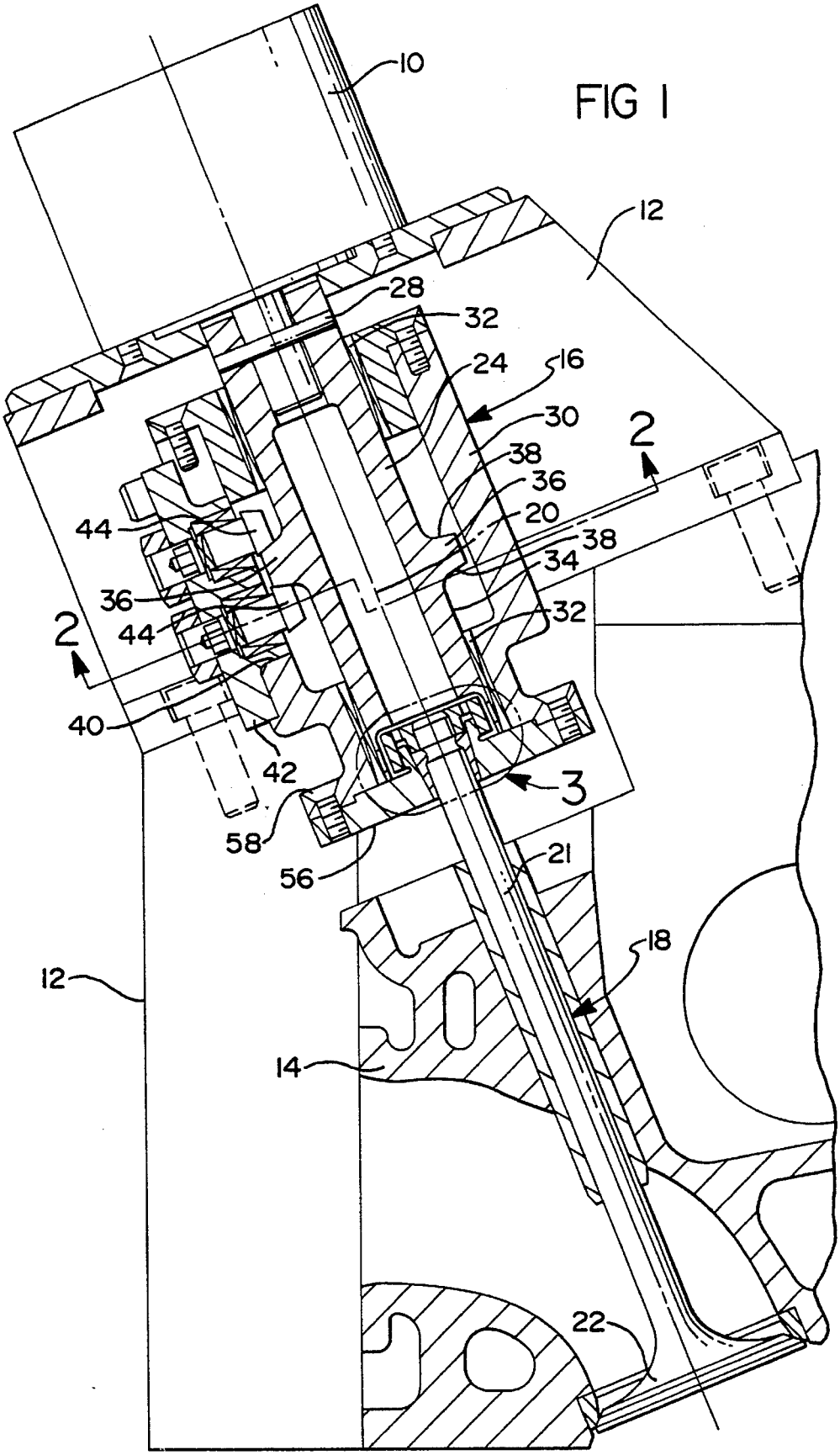
FIG. 1 is a partial cross section of an engine having a motor driven valve according to the invention and showing cam mechanism details.

FIG. 1 shows an engine having a valve arrangement comprising a rotary electric motor 10, supported by a mounting bracket 12 on a cylinder head 14. A cam mechanism 16 is mounted at one end to the motor 10 and a poppet valve 18 is mounted at the other end of the mechanism 16. The motor 10 axis of rotation shares a common axis 20 with the cam mechanism and the valve 18. The valve 18, which may be either an intake or exhaust valve, has a stem 21 which engages the mechanism 16 and a head 22 which seats in a port of the cylinder head 14.

The cam mechanism 16 comprises two generally cylindrical tubular members coaxial with the common axis 20. The members are an inner rotary cylindrical cam 24, which is coupled to the motor 10 shaft 26 by a pin 28, and an outer follower sleeve 30 which is held against rotation and is mounted for reciprocating motion on the cam 24 by linear and rotary bearings 32. The cam 24 has a cylindrical outer surface 34 and an outer cam lobe 36 outstanding radially from the cylindrical surface 34. The lobe 36 wraps around the cam 24 in a path according to the desired cam lift profile, to be described. The side surfaces 38 of the lobe are the cam surfaces and are inclined toward each other. The follower sleeve 30 has an opening 40 on one side which contains a follower insert 42 carrying a pair of axially spaced rollers 44 in contact with the cam surfaces 38 of the cam 24. The rollers 44 are tapered or frustoconical to match the angle of the inclined cam surfaces 38.

FIG. 2 shows a cross section of the cam mechanism with details of the follower insert 42. A pair of bores 46 in the insert 42 each contain bearings 48 which support the rollers 44 for rotation, each roller having an integral shank 50 in contact with the bearings. End thrust on each roller is taken by a set of disc springs 52 and a rounded button 54 which is pushed by the springs 52 against an end of shank 50, whereby the rollers 44 are firmly and resiliently held against the cam surfaces 38.

The end of the follower sleeve 30 adjacent the valve 18 carries a valve retainer 56 as shown in FIGS. 1 and 3. The retainer 56 is a plate held onto a flange on the sleeve 30 by screws 58, and has a central conical aperture 60 which flares outward toward the side nearest the motor 10. The aperture is surrounded by an externally threaded hub 62. The end of the valve stem 21 extends through the aperture and has a retaining groove 64 around the stem. A split ring 66 (or conventional keepers) in the aperture 60 has a tapered outer surface nesting in the aperture and an internal rim 68 which seats in the groove 64 of the valve stem 21. A nut 70 threaded over the hub 62 bears against the split ring 66 to clamp the ring and lock the valve stem in place. In addition, lubrication means, not shown, may be used to reduce friction and wear in the cam mechanism. Some valve lash adjustment means, not shown, may be included in ways known in the prior art, in order to make up for tolerance variations from one unit to another and to compensate for temperature, aging and other possible dimensional variations. These may comprise mechanical lash adjusters, shims to be set during assembly, or hydraulic valve lifters possibly assembled with a small return spring.

In the position shown in FIG. 1 the cam follower is in its highest position and the valve 18 is closed. Upon motor 10 rotation the cam 24 also rotates causing the follower to move down in accordance with the cam lobe profile to full open position of the valve and upon continued rotation to return to the starting position, the cycle repeating indefinitely during engine operation.

Figure 4A:
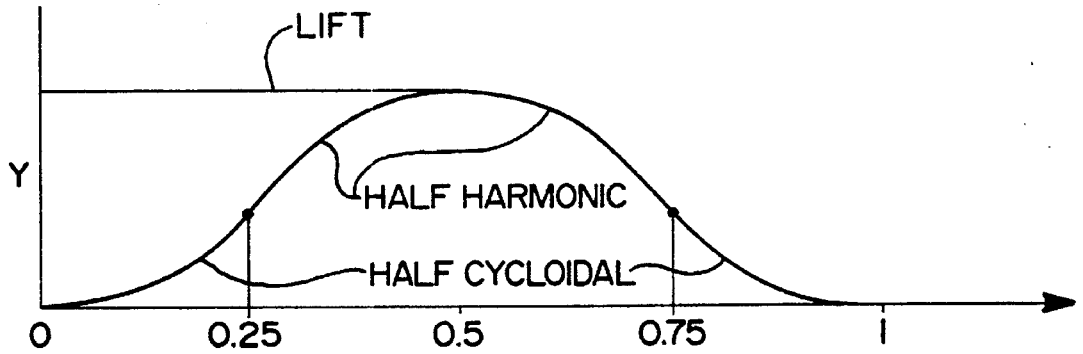
FIGS. 4*a*–4*d* are graphical representations of examples of valve lift, corresponding valve velocity, valve acceleration and inertia force, respectively, for the configuration of FIG. 1.
Figure 4B:
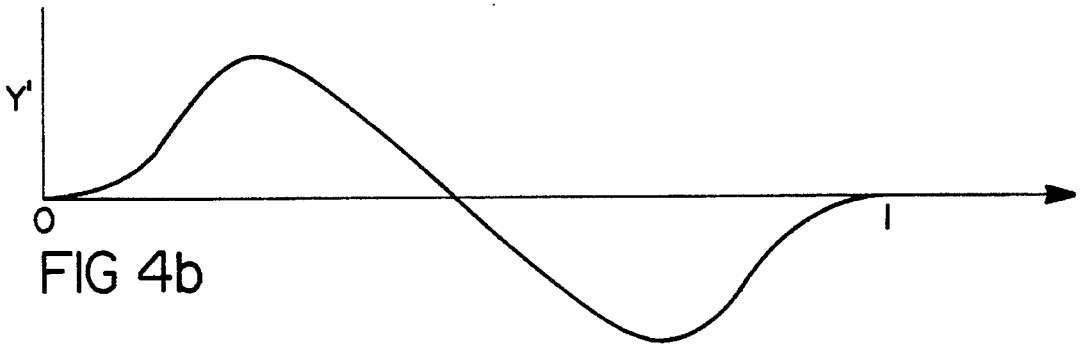
Figure 4C:
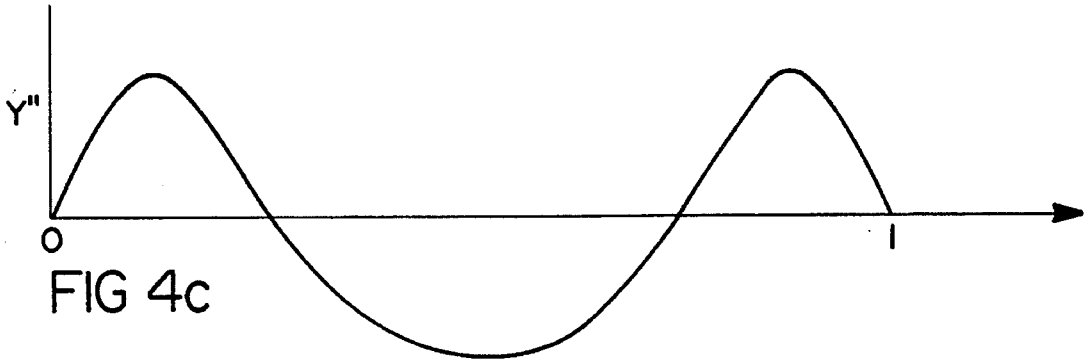
Figure 4D:
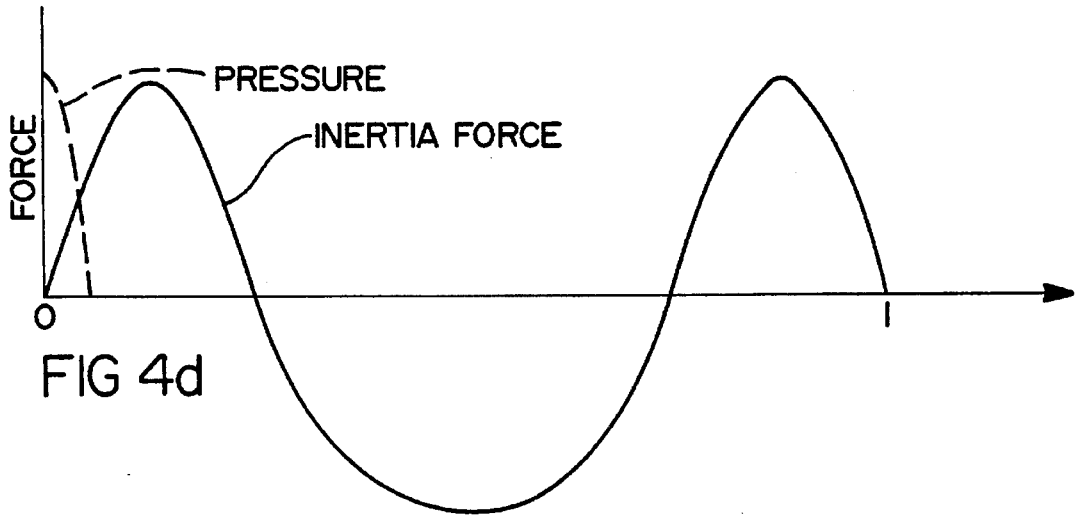

The cam profile is dependent on specific engine characteristics. An example is given in FIG. 4*a* where the initial ¼ of the lobe, beginning at the onset of valve opening, is half-cycloidal, the next ½ of the lobe is half-harmonic, and the final ¼ is half-cycloidal. The extent of the lobe is a matter of engine design but may be, for example, about 120° of the cam circumference, the remaining part of the cam being flat at the valve closed position. This profile is a conventional pattern known to cam designers and has the advantage of slowly opening and closing the valve to minimize stresses on the cam-valve assembly. The valve velocity and acceleration, assuming a constant motor speed, is shown in FIGS. 4*b* and 4*c*, respectively, and the inertial force on the cam mechanism is proportional to acceleration, as shown in FIG. 4*d*. By eliminating the conventional valve spring the force is sometimes in one direction and sometimes in the other direction, and is distributed across the valve open period, keeping the peak force small. The motor 10 thus drives the valve 18 in both directions, applying actuation force from the cam to the follower rollers 44. In the case of exhaust valves, a force due to high combustion chamber pressure is present only just as the valve opens and dissipates before the inertial force becomes large, as shown in FIG. 4*d*. This force is of the same order of magnitude as the peak inertial force, and thus a cam mechanism designed to provide rolling-only conditions with respect to the maximum inertia force will also be capable of opening the exhaust valve against the combustion chamber pressure.

Figure 5:
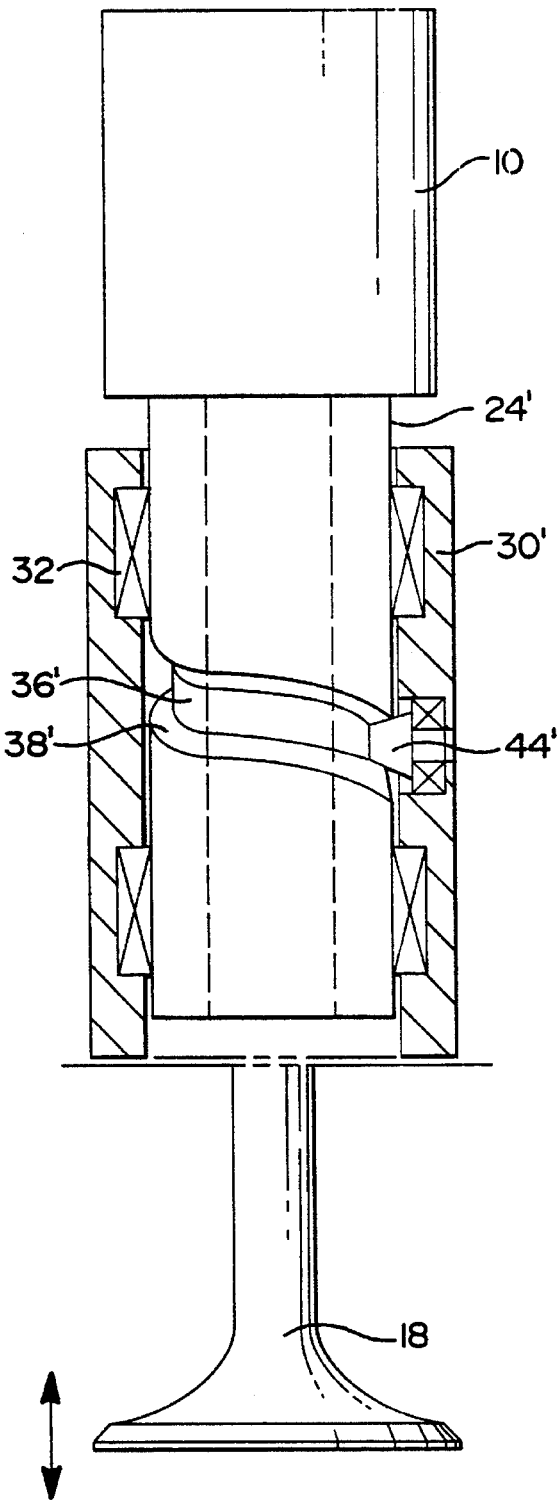
FIGS. 5 and 6 are partial cross sections of motor driven valves having alternative cam mechanisms.
Figure 6:
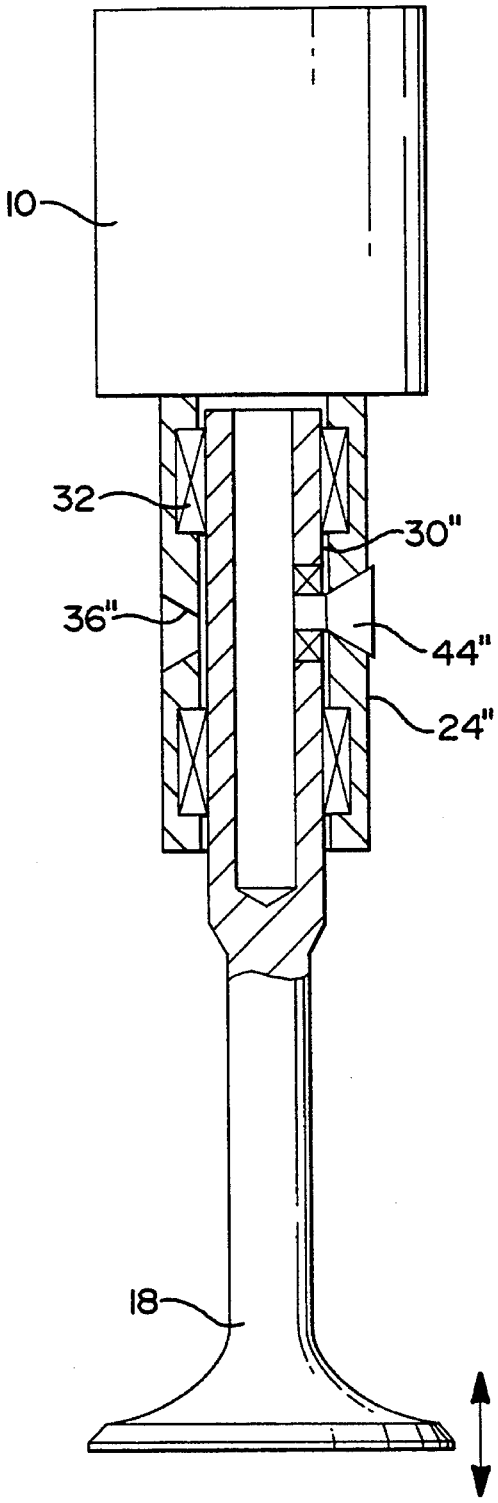

Other cam mechanisms using the same cam shape and motor drive are also envisioned. FIG. 5 shows a cam mechanism which differs from that of FIG. 1 by employing a cam groove 36' on the rotary cam 24' instead of a protruding lobe, the groove having inclined sides 38' forming cam surfaces, and a single frustoconical follower roller 44' on the follower sleeve 30'. Cylindrical follower rollers and complementary grooves could be used instead, but frustoconical rollers eliminate excessive slip between roller and cam to reduce wear. FIG. 6 depicts a cam mechanism where the outer member is the rotation cam 24" driven by the motor 10 and affords a cam groove 36". A frustoconical roller 44" carried by the inner follower 30" engages the groove 36" to reciprocate the follower and valve 18 as the cam 24" rotates. This version reduces translational inertia which is effective for high speed control of the valve as well as reducing the force and torque levels, which in turn increase the life of the mechanism. In all cases, suitable means, not shown, are included to prevent rotation of the reciprocating cam follower 30, 30', 30".

Figure 7A:
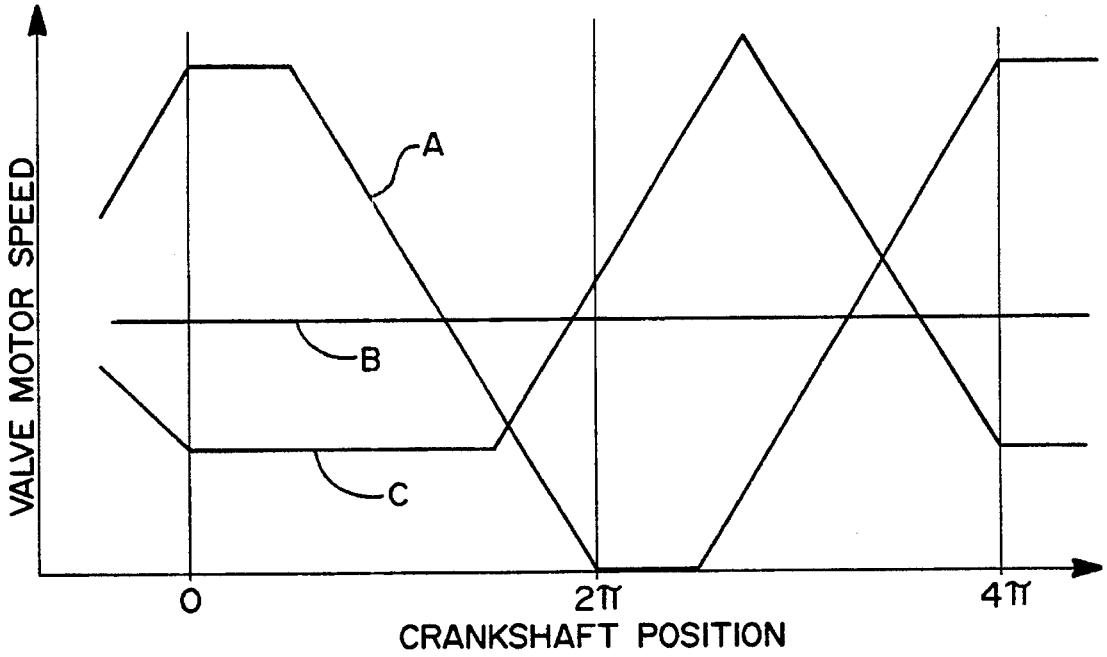
FIGS. 7A and 7B are graphs of valve motor speed and corresponding valve lift, respectively for different valve open periods.
Figure 7B:
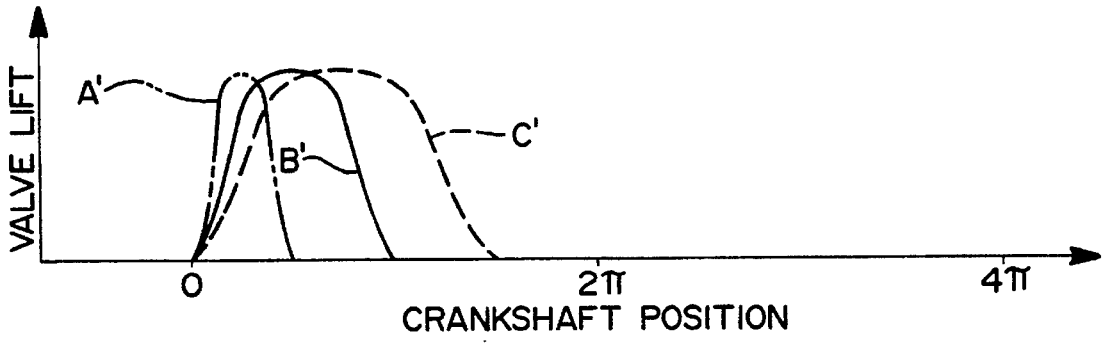

While the forces just described are determined by the cam profile and a constant motor speed, they can be modified by varying the motor speed. Also, speed variation is used to adjust valve timing, the duration of the valve event and the rate of opening and closing. In FIG. 7*a* three different motor velocity profiles A, B, and C are shown and FIG. 7*b* shows corresponding valve lift profiles A', B' and C'. Velocity profile B is a constant motor speed, which is one half of the engine speed, and the corresponding valve lift profile B' is determined by the cam shape. Velocity profile A has a higher speed than profile B during the valve open period resulting in a short open period as shown in the lift profile A'. The motor velocity decreases to a low value and may even stop or reverse when the valve is closed to compensate for the high velocity and maintain phase synchronization. The velocity increases again to the high value at the next time of valve opening. Thus over the entire cam rotation period (two engine revolutions) the average motor speed is the same as profile B speed, given the same engine speed. Velocity profile C has a low velocity during valve opening resulting in a long open period of valve lift profile C', and the motor is accelerated after valve closing to increase the speed to a higher value while the valve is closed so that again the average speed will be the same to assure phase synchronization. If the average speed were adjusted to be higher or lower than half the engine speed, the valve timing will be advanced or retarded, respectively. Thus the phase is readily adjusted by the motor speed. Once the timing adjustment is achieved, restoring the average motor speed to half the engine speed will synchronize the , valve operation at the new phase angle.

Figure 8A:
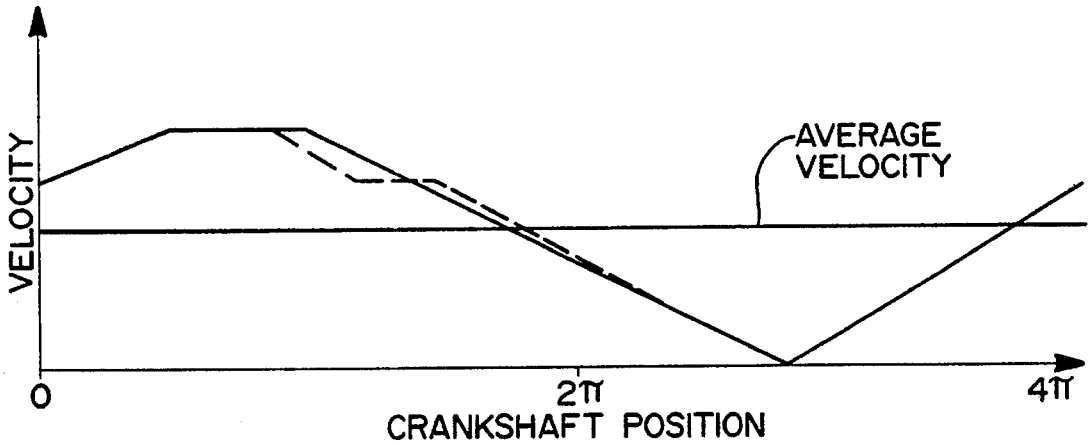
FIGS. 8A and 8B are graphs of valve motor speed and corresponding valve lift, respectively, illustrating the effect of lower motor speed at valve seating.
Figure 8B:
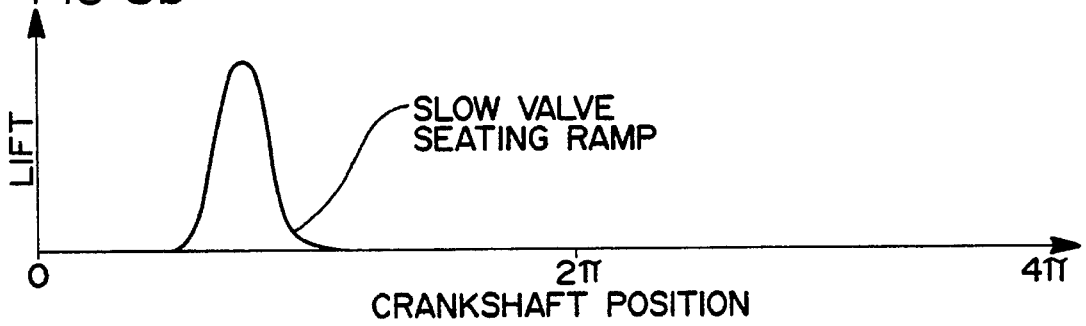

An example of reducing the valve seating velocity by varying motor speed is shown in FIGS. 8A (motor velocity) and 8B (valve lift profile). The solid velocity profile is similar to profile A of FIG. 7. The dashed portion, occurring late in the valve open period, shows reducing the motor velocity until the valve is seated and then approaching the solid line velocity profile by a path to maintain the correct average velocity. The slower motor velocity is reflected in the valve closing profile. This more gradual seating velocity reduces stress on the valve and the seat and reduces audible noise even further than the cam design itself does, thus enhancing valve life and driver comfort.

Figure 9A:
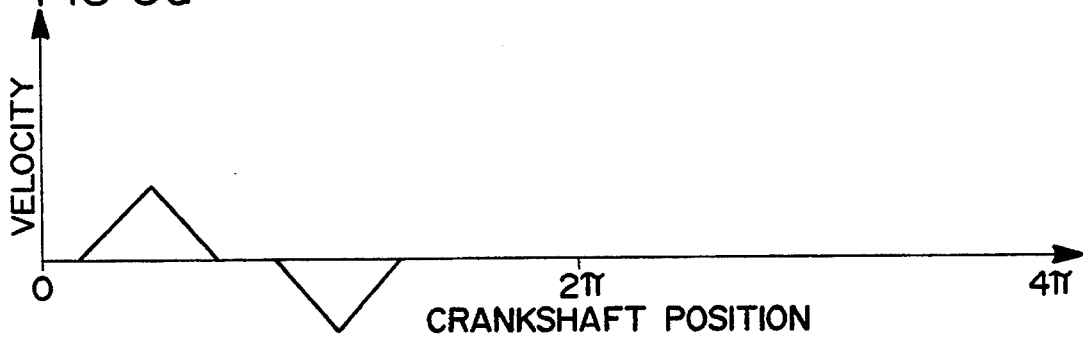
FIGS. 9A and 9B are graphs of valve motor speed and corresponding valve lift, respectively, illustrating the effect of partially opening a valve by reversing motor direction after the valve is partially opened.
Figure 9B:
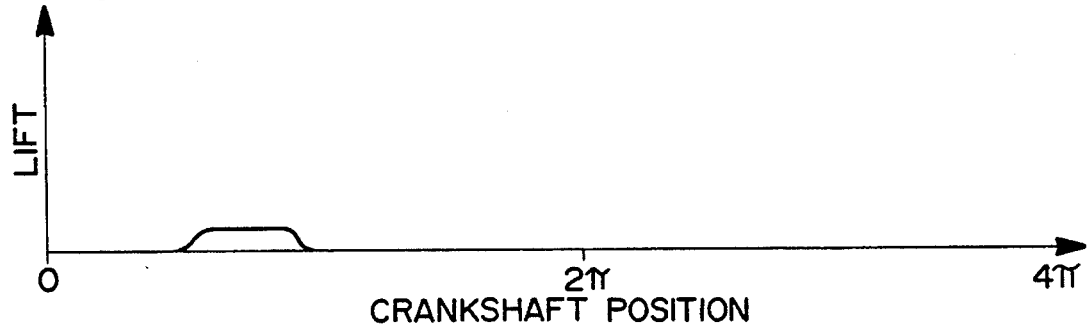

In addition to the mechanical reasons for varying motor speed, there are thermodynamic reasons. For example, opening and closing the valves more rapidly would reduce valve throttling. This, however, could conflict with the desire to lower mechanical stress. In any event the motor drive has the capability to carry out either operation. Another example of a thermodynamic advantage consists of stopping the valve as it is only partially open, since this can produce swirl at low engine speeds to improve combustion at low loads and at idle. FIGS. 9A and 9B, showing motor speed and valve lift respectively, illustrate this capability. Unlike the previous examples where the average motor speed is one half the engine speed, here the motor has a zero average velocity and the system operates in a reciprocating mode. Thus the motor operates in one direction enough to partially open the valve, stops for a time, and then operates in the other direction to close the valve, and stops again until the cycle is repeated.

It may also be advantageous to stop the valve motor for periods of time extending over several engine cycles. For instance, one or several cylinders may be deactivated in order to reduce the engine output. The cylinders could be deactivated one at a time to spread fatigue evenly and avoid temperature rise gradients across the engine block. Another purpose for cylinder deactivation would be in case of a malfunction of the spark plug, fuel or valve system in a specific cylinder, in order to provide limp-home capability until the engine is serviced. Generally speaking, cylinder deactivation can be performed with the valves either open or closed. Engine starting can benefit by keeping a valve open to reduce compression effort until the engine is driven up to a certain speed, prior to operating the valves normally and starting fuel and spark for engine ignition.

Consumption of energy by the motor is minimized if the current into the motor is as constant as possible. Thus additional consideration in cam or valve design as well as motor velocity profiles affect the motor current and energy consumption. The valve open duration as the motor is run at constant speed is an important design parameter. It may be envisioned that the best design is one where the duration is of average extent so that all possible open durations are essentially evenly distributed on either side of the designed duration. This would reduce the scope of the acceleration/deceleration cycles and hence reduce mechanical stress and overall energy requirement. However, it may be preferable to use instead a valve open duration which is deemed desirable at high engine speeds, thus facilitating engine operation at such high speeds and reserving the variations in valve open durations to the lower speeds where considerably more time is available for acceleration and deceleration.

For a given engine design, the tradeoffs among the mechanical reasons, thermodynamic reasons and energy consumption reasons must be studied to arrive at the best possible characteristics. The optimum cam-motor profile or rotary valve design will depend on engine speed and other parameters. The actual mechanical cam profile is one of the factors subject to design considerations as well as the cam-motor characteristics.

The rotary valve does not require a cam mechanism and by design there is no concern about seating velocity. Otherwise most of the beneficial features of the electrical motor drive apply to the rotary valve. Shown in FIGS. 10 and 11, the rotary valve comprises a generally spherical valve 80 rotatable about an axis 82 by a shaft 84. The shaft 84 may be directly coupled to a motor having its axis aligned with axis 82, or, as depicted here, it is coupled through a bevel gear 86 to the motor 88 which lies at right angles to the axis 82 of the valve 80. This disposition of the motor is advantageous from the standpoint of reducing engine height. A motor controller 90 drives the motor at the required relationship to the engine crankshaft to attain correct valve timing. Unlike the popper valve, the rotary valve reaches an open position twice per motor revolution, (.assuming a 1:1 gear ratio) and thus must be driven at an average speed of one fourth of the engine crankshaft speed. Still, for each valve cycle consisting of a half revolution, the valve opens and closes once while the engine makes two revolutions.

Figure 11:
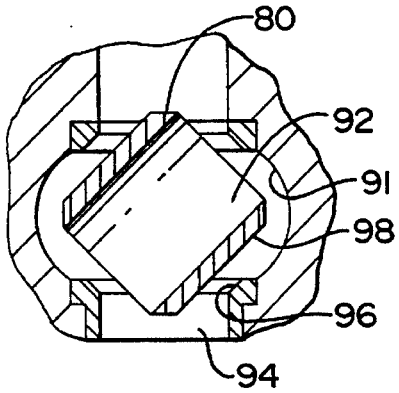
FIG. 11 is a cross section of the rotary valve of FIG. 10 in an induction passage.

The valve 80 resides in a cavity 91 in a cylinder head adjacent an engine port 94 and has a cylindrical passage 92 for passing engine gases when the passage is open to the engine port. FIG. 11 shows the valve 80 in a partially open position. The engine port 94 has a seal 96 for engaging the valve 80 when in closed position. The sides 98 of the valve to either side of the passage 92 opening are flat to reduce sliding contact with the port seal 96 and to increase flow in partially open position.

The motor itself may be one of several types but a permanent magnet brushless motor is preferred. Current is provided to such a motor from a vehicle DC system by a DC to AC inverter, which determines the current and the frequency of the AC power. A motor with very fast acceleration and deceleration is required to provide the largest flexibility in valve event duration. A slew rate of more than 10,000 rad/sec/sec is estimated to be needed in order to retain flexibility at the highest engine speeds (6000 rpm). Taking into account the inertia of the cam mechanism, the acceleration-torque requirement is estimated to be 50 Oz-in for continuous mode of operation with peak torque capability of 200 Oz-in. Brushless motors with high energy magnets (NdFe or SmCo) can be designed to provide accelerations in excess of 40,000 rad/sec/sec. Higher torque/inertia can be obtained by a proper choice of the number of poles, diameter and length of the rotor. One such design has a package size on the order of 5 cm diameter and 6 cm long.

The motor 10 for each valve 18 is driven by a controller 100 through a drive 102 as shown in FIG. 12. (The same arrangement is true in the case of rotary valves 80 driven by motors 88.) An engine control module (ECM) 104, which is a microprocessor based control and is normally used to manage fuel control and spark timing, has a number of inputs which affect engine operation such as engine speed, accelerator pedal position, brake pedal position, anti-lock brake or traction control system state, engine coolant temperature, and the driver's style, for example. The optimum valve lift and timing can be determined by the ECM 104 for any given set of conditions and fed to each of the controllers 100. One technique for such ECM control is to define several valve timing profiles and incorporate each in a look-up table in the controller, and a given lift is selected by command from the ECM. Another approach is for the ECM to provide one or more valve parameters, and for the controller to execute an algorithm operating on the parameters. In addition to the ECM command, each controller is provided with a pulse train from a crankshaft sensor 105 to accurately indicate incremental changes in crankshaft position.

Figure 13:
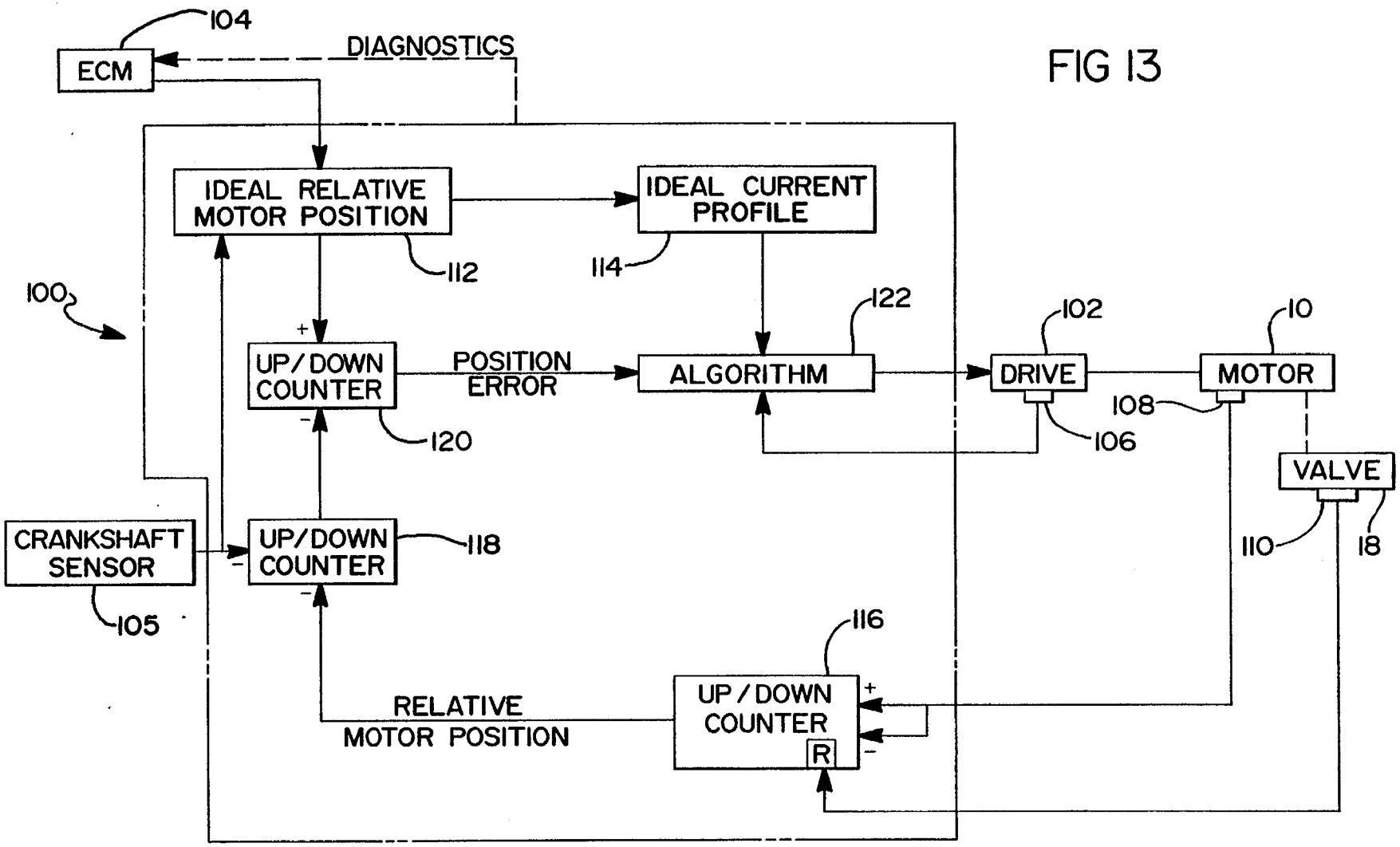
FIG. 13 is a detailed schematic diagram of a controller of FIG. 12.

FIG. 13 shows the plan of the controller 100 and input connections from the ECM 104 and feedback from transducers coupled to the drive 102 the motor 10 and the valve 18. The controller 100 has an input from the ECM 104 and produces a current command which is fed to the drive 102. The drive, coupled to a DC source, not shown, produces a motor current in proportion to the command. A current sensor 106 in the drive produces a motor current feedback to the controller. A motor position sensor 108 generates a train of pulses indicating the incremental position changes due to motor rotation, the pulse rate being nominally the same as that from the crankshaft sensor 105. The position sensor 108 may have an index signal occurring once per revolution to provide an absolute reference point indirectly related to a valve position. Alternatively, a valve position detector 110 is used to directly provide an absolute valve position once per cycle.

The controller 100 is a microprocessor based control which determines the correct relationship of crankshaft position and motor position, according to parameters or commands from the ECM, and produces a current command to the drive 102. When the valve motor 10 is operating in full synchronism with the crankshaft, each pulse from the motor transducer (position sensor) 108 will match a corresponding pulse from the crankshaft transducer (position sensor) 105, and the valve lift and timing will be according to the basic profile established by the cam mechanism. Any desired variance from that basic profile can be expressed as a desired phase difference between the motor and crankshaft. By detecting the actual phase and comparing it to the desired phase, an error is determined and the motor current can be adjusted accordingly. In the description of the controller 100 up/down counters are used to make the necessary phase comparisons but other equivalent techniques may be used instead.

The controller 100 includes an ideal relative motor position module 112 programmed to determine the ideal motor position in terms of the motor/crankshaft phase. Here, the number of transducer pulses is used to express the phase. Preferably, the module 112 contains a set of look-up tables each corresponding to a valve event profile, and each having a desired phase difference value for each crankshaft position. The ECM decides which table to use. Alternatively, an algorithm using parameters from the ECM can calculate the desired phase information. An ideal current profile module 114, linked with the ideal position module 112, determines the best current profile for present conditions either by tables or by an algorithm. This ideal current profile may take into account the expected load torque profile of the cam versus motor position, as well as motor and drive characteristics. An up/down counter 116 has a reset terminal connected to the valve position detector for setting the counter to zero at a particular valve position or index. The motor position sensor 108 is coupled to the counter 116 and provides either up or down inputs depending on motor direction. The counter 116 output is motor position relative to the index and is compared to the pulse signal from the crankshaft sensor 105 by a second up/down counter 118. When the crankshaft and the motor are in full synchronism the counter 118 output is zero, and a phase difference will result in a positive or negative output of a value dependent on the amount of difference. A third up/down counter 120 compares the output of counter 118 with the ideal phase from the module 112. Any position error is output from counter 120 to an algorithm module 112 which computes a drive current command from the position error, the ideal current profile, and the current sensor feedback.

While the invention has been described by reference to certain embodiments, it should be understood that numerous additional changes could be made within the spirit and scope of the inventive concepts described. Accordingly it is intended that the invention not be limited to the disclosed embodiments, but that it have the full scope permitted by the language of the following claims.

The embodiments of the invention in which an exclusive property or privilege is claimed are defined as follows:

1. In an internal combustion engine having a poppet valve actuated by a rotary electric motor, the method of valve control comprising the steps of:

rotating the motor at an average velocity proportional to engine speed;

employing a cam mechanism for converting motor rotation to reciprocating valve motion for repetitively opening and closing the valve, the valve having a prescribed lift profile for a constant motor speed; and reducing motor velocity near the transition from a closed valve position to an open valve position to alter the shape of the lift profile when the valve is slightly open and thereby reduce stress on the cam mechanism.

* * * * *